United States Patent [19]

Kiefer

[11] Patent Number: 5,011,102

[45] Date of Patent: Apr. 30, 1991

[54] MAGNETIC KNIFE HOLDER

[76] Inventor: Walter J. Kiefer, 1137 N. Patterson, Santa Barbara, Calif. 93111

[21] Appl. No.: 516,690

[22] Filed: Apr. 30, 1990

[51] Int. Cl.[5] ..... A47G 21/14

[52] U.S. Cl. ..... 248/37.3; 211/DIG. 1; 248/309.4

[58] Field of Search ..... 248/37.3, 37.6, 309.4, 248/206.5; 211/13, 60.1, 70.7, DIG. 1; D7/637

[56] References Cited

U.S. PATENT DOCUMENTS

| | | | |
|---|---|---|---|
| 1,614,342 | 1/1927 | Bleckley | 211/70.7 X |
| 1,876,284 | 9/1932 | Fried | 248/37.6 X |
| 2,566,082 | 8/1957 | Droshine | 248/37.6 |
| 2,903,171 | 9/1959 | Rutledge | 211/70.7 X |
| 2,955,239 | 10/1960 | Rouse | 248/37.6 X |
| 3,980,608 | 9/1976 | Faltersack | 248/37.3 |
| 4,544,067 | 10/1985 | Miller | 211/DIG. 1 X |
| 4,787,582 | 11/1988 | Geleziunas | 248/309.1 X |
| 4,934,539 | 6/1990 | Lu | D7/637 X |

FOREIGN PATENT DOCUMENTS

| | | | |
|---|---|---|---|
| 2495531 | 6/1982 | France | 211/70.7 |

*Primary Examiner*—J. Franklin Foss

*Attorney, Agent, or Firm*—Harry W. Brelsford

[57] ABSTRACT

A magnetic knife holder has the magnets covered top and bottom by a cowling. The cowling have a curved entry to guide the knife to the magnets. The cowlings have a restricted rear exit slot to reduce the angle of movement of knife with respect to the magnets if the knife is accidentally struck, to thereby assist in retaining the knife on the magnets.

2 Claims, 1 Drawing Sheet

MAGNETIC KNIFE HOLDER

This invention relates to magnetic knife holders and has particular reference to a novel cowling that acts as a guide to insert knives in the holder.

BACKGROUND OF THE INVENTION

Magnetic knife holders are widely used by housewives and professional cooks. The most common type is a U shaped elongated magnet which is placed on the bottom of a cabinet or on vertical surface. Gravity causes the knives to fall when accidently bumped, creating a hazard.

BRIEF DESCRIPTION OF THE INVENTION

The invention provides a cowling over the magnetic strip of a magnetic knife holder. The cowling has a curved entry to guide the knives toward the magnetic strip. The cowling also has tapered rear surfaces having trailing edges that are spaced apart to define a rear guide. If the user inserts a knife between the entry cowling at a transverse angle, the rear guide straightens out the knife direction to guide it into a safe direction so that the knife points will not gouge the surface to which the knife holder is attached. This same combination of front and rear guides limit the dislocation of a knife that is accidentally struck. Even if the accidental blow momentarily disengages a knife from the magnets, the limited dislocation is so small that the magnets immediately grasp the knife again. Even vertically mounted magnetic holders of the invention provide a safe mounting for the knives.

DESCRIPTION OF THE DRAWING

In the drawings forming an integral part of this specification.

DETAILED DESCRIPTION

Figure 1:
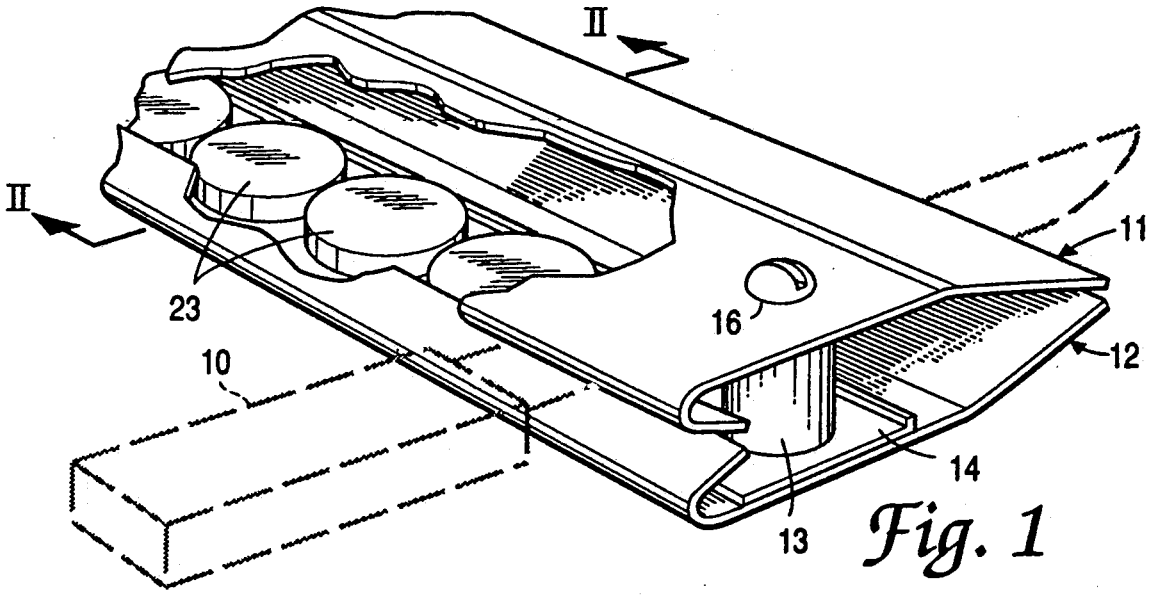
FIG. 1 is a three dimensional view of one end of a magnetic knife holder embodying the invention with a knife inserted therein in phantom outline.
Figure 2:
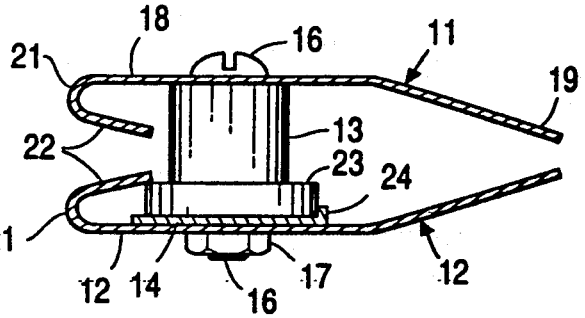
FIG. 2 is a sectional view of the knife holder along the line II—II of FIG. 1.

Referring to the drawings a knife 10 in phantom outline is inserted between a pair of spaced linear cowlings 11 and 12. These are spaced by a pair of tubular cylinders 13 on each end of the cowlings; only one is shown in FIG. 1 and the other is shown in FIG. 2. Disposed under the spacers 13 is a magnet strip 14 shown in plan view in FIG. 3. A bolt or screw 16 at each end of the assembly passes through the cowlings 11 & 12 and magnet strip 14 and through the tubular spacers 13 and is secured by a nut 17 to hold the assembly together.

The cowlings 11 and 12 are preferably similar mirror images having a generally horizontal section 18 and a tapered rear section !9. Each cowling has a forward curved nose section 21 terminating in a guide strip 22 bent at an acute angle to the horizontal portion 18. The curved noses 21 and the guide strip 22 make it easy for the user to insert knives into the assembly, acting as smooth guides for this purpose.

Figure 3:
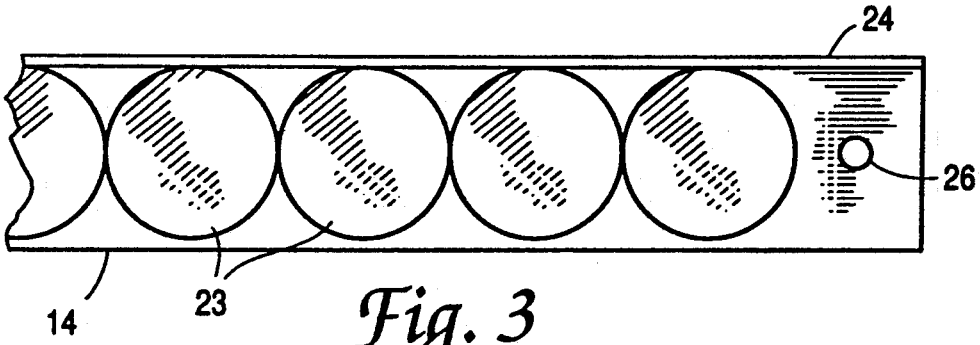
FIG. 3 is a plan view of the magnet strip of FIGS. 1 & 2 showing disc magnets located on the strip.

The magnet strip 14 is provided particularly in accordance with the invention. I have found that the common disc magnets of ceramic or similar material are inexpensive but very powerful. These are shown in FIGS. 3 & 4 as disc magnets 23. The retention of these in the assembly is best shown in FIG. 2. The magnet strip 14 has a low flange 24 and bolt holes 26. The location of the bolt holes 26 with respect to the flange 24 and the diameter of the disc magnets 23 is carefully selected so that the magnets 23 are pressed under the lower guide 22 to retain the magnets in place. This is shown in FIG. 2. The magnet strip 14 should be formed of ferrous or magnetic material. I have found that it is not necessary to orient adjoining magnets with opposite fields and any random pattern of adjoining polarity is satisfactory. The sheet metal guide 222 that holds the magnets is much thinner than shown and according there is little air gap between the knives 10 and the magnets 23.

The cowlings 12 and 13 are preferably formed of non-ferrous sheet metal and non-magnetic stainless steel and aluminum are satisfactory.

If it is desired to mount the assembly in a horizontal position as shown in FIG. 1, suitable angle brackets may be secured to the bolts 16 for this purpose. The assembly works well in a vertical mounting also because the powerful disc magnets hold the knives very securely with the knive handles down and the guides 22 and 19 limit the dislocation of the knives when accidentally struck.

The strips 12, 13 and 14 are elongated or linear and the length depends upon the number of knives to be held. I presently prefer strips about twelve inches long and two inches wide. The gap between the rear strips 19 help to guide the knives. If the assembly is mounted under a cabinet the knives might dig into the bottom of a cabinet if they are not also guides at the rear surfaces 19.

I have described my invention with respect to the presently preferred embodiment as required by the patent statutes. Various modification and improvements will be apparent to persons skilled in the art and all such modifications and improvements that come within the true spirit of the invention are included within the scope of the following claims.

I claim:

1. A magnetic knife holder having a front and rear comprising:

(a) a pair of spaced elongated cowlings each having a front curved nose and a guide strip projecting rearwardly from the nose and inclined toward each other;

(b) an elongated strip of magnetic material disposed between the cowlings and having a rear flange;

(c) and a plurality of disc magnets disposed on the strip of magnetic material between the flange and the rear edge of one of the guide strips to underlie the rear edge of said one guide strip.

2. A magnetic knife holder as set forth in claim 1 wherein the cowlings are apertured and the strip of magnetic material is apertured and a fastener passes through the apertures to maintain the alignment of magnetic discs with said rear edge of said front guide strip.

* * * * *